United States Patent [19]

Mishima et al.

[11] Patent Number: 4,941,017

[45] Date of Patent: Jul. 10, 1990

[54] COPYING APPARATUS HAVING A BINDING MARGIN FORMING FUNCTION

[75] Inventors: Nobuhiro Mishima; Kazuhiro Araki, both of Osaka, Japan

[73] Assignee: Minolta Camera Kabushiki Kaisha, Osaka, Japan

[21] Appl. No.: 238,843

[22] Filed: Aug. 31, 1988

[30] Foreign Application Priority Data

Aug. 31, 1987 [JP] Japan ..... 62-218492

[51] Int. Cl.[5] ..... G03G 15/00

[52] U.S. Cl. ..... 355/218; 355/243; 355/317

[58] Field of Search ..... 355/218, 243, 317, 324, 355/55, 24, 25, 233

[56] References Cited

U.S. PATENT DOCUMENTS

| | | | |
|---|---|---|---|
| 4,260,242 | 4/1981 | Nishikawa | 355/210 |
| 4,451,136 | 5/1984 | Tanioka et al. | 355/210 |
| 4,501,490 | 2/1985 | Miyamoto et al. | 355/218 X |
| 4,579,445 | 4/1986 | Hasegawa | 355/243 |
| 4,682,158 | 7/1987 | Ito et al. | 355/209 X |
| 4,690,545 | 9/1987 | Maehara | 355/233 X |
| 4,740,810 | 4/1988 | Ito et al. | 355/218 X |

*Primary Examiner*—Joan H. Pendegrass

*Attorney, Agent, or Firm*—Burns, Doane, Swecker & Mathis

[57] ABSTRACT

When a both-sided binding margin mode is set, data for forming binding margins on two opposing side edges of paper are set. More specifically, a copying magnification based on a size of an original and a size of the copy paper and a count value for determining timing for feeding copy paper are set. Based on those data, an image of a specified magnitude is formed on a photoconductor and this image is transferred, at a transfer position, onto an image area of the copy paper defined by subtraction of a predetermined binding margin width from each of a leading edge and a rear edge of the copy paper. As a result, the copy image is formed with the binding margins being ensured on both edges of the copy paper.

8 Claims, 12 Drawing Sheets

| SIZE | COUNT VALUE C | MAGNIFICATION Z |
|---|---|---|
| A3 | 205 | 0.976 |
| B4 | 206 | 0.972 |
| A4T | 207 | 0.966 |
| B5T | 208 | 0.961 |
| A5T | 210 | 0.952 |
| B6T | 212 | 0.945 |
| A6T | 215 | 0.932 |
| A4Y | 210 | 0.952 |
| B5Y | 212 | 0.945 |
| A5Y | 215 | 0.932 |

FIG.15A

| SIZE | COUNT VALUE C | MAGNIFICATION Z |
|---|---|---|
| A3 | 420 | 0.952 |
| B4 | 423 | 0.945 |
| A4T | 429 | 0.933 |
| B5T | 434 | 0.922 |
| A5T | 442 | 0.905 |
| B6T | 449 | 0.890 |
| A6T | 462 | 0.865 |
| A4Y | 442 | 0.905 |
| B5Y | 449 | 0.890 |
| A5Y | 462 | 0.865 |

FIG.15B

| SIZE | COUNT VALUE C | MAGNIFICATION Z |
|---|---|---|
| A3 | 646 | 0.929 |
| B4 | 654 | 0.918 |
| A4T | 667 | 0.899 |
| B5T | 680 | 0.883 |
| A5T | 700 | 0.857 |
| B6T | 719 | 0.835 |
| A6T | 753 | 0.797 |
| A4Y | 700 | 0.857 |
| B5Y | 719 | 0.835 |
| A5Y | 753 | 0.797 |

COPYING APPARATUS HAVING A BINDING MARGIN FORMING FUNCTION

CROSS-REFERENCE TO RELATED, COPENDING APPLICATION

A related copending application of particular interest to the present application is the U.S. Pat. Appln. Ser. No. 209,644 filed Jun. 21, 1988 entitled "Copying Machine", assigned to the assignee of the present application.

BACKGROUND OF THE INVENTION

1. Field of the Invention

The present invention relates to copYing apparatus and particularly to a copying apparatus for optically scanning an original, forming, on a photoconductor, an optical image of the original of a magnitude variable according to a set copying magnification, and transferring the optical image onto paper.

2. Description of the Prior Art

Copying apparatus having a so-called one-sided binding or blank margin mode for making a copy with a margin of 5 mm, 10 mm or 15 mm for example on one side edge of paper is well known.

FIG. 1 shows an example in which an original is copied in the one-sided binding or blank margin mode.

In FIG. 1, the left illustration shows a size of an original to be copied and the right illustration shows a copy of the original (the hatched area corresponding to the original). In this example, a scaled-down magnification is applied to an optical image of the original and timing for transferring the image is delayed, whereby a blank space for binding is formed on one side of the copy paper as shown in the right illustration.

Thus, a margin for binding in the conventional binding margin mode is formed only on one side edge of paper. Let us assume for example that a document of the A4 size is copied in the binding margin mode and that the copies thus obtained are filed in the A4 size. In this case, if the two facing pages of the filed copies are opened, either of the pages is blank, that is, a back face of the copy. In order to avoid this inconvenience, some users desire to make copies of the A3 size, to fold each copy in two and to file the folded copies in the A4 size.

FIG. 2 shows an example in which an original is copied in a both-sided binding margin mode so as to be folded for filing.

In FIG. 2, the left illustration shows a size of the original to be copied and the right illustration shows a copied state (the hatched area corresponding to the original). Thus, after filing of the copies obtained in the both-sided binding margin mode, both of the two opposing pages to be opened are copy faces and the filed document is convenient to use.

SUMMARY OF THE INVENTION

An object of the present invention is to provide a copying apparatus in which copies suitable for filing can be obtained.

Another object of the present invention is to provide a copying apparatus in which copies to be folded for filing can be obtained.

Still another object of the present invention is to provide a copying apparatus capable of copying an original on predetermined paper to be filed without causing any deficiency of an image.

A further object of the present invention is to provide a copying apparatus capable of providing binding or blank margins on both sides of copy paper without causing any deficiency of an image on the paper.

A further object of the present invention is to provide a copying apparatus capable of designating a width of a blank margin on copy paper to be filed.

In order to accomplish to the above described objects, a copying apparatus according to the present invention comprises a rotating photoconductor, image forming means, paper feed means, transfer means, detection means, mode designation means and determination means. The image forming means forms an image of an original on the photoconductor with an arbitrary magnitude based on a copying magnification. The paper feed means feeds copy paper to a predetermined transfer position with predetermined timing. The transfer means transfers the image on the photoconductor formed by the image forming means onto the copy paper at the transfer position, fed by the paper feed means. The detection means detects the size of the copy paper fed by the paper feed means. The mode designation means designated a mode for assuring a binding margin of a predetermined width at a leading edge and at a rear edge of the copy paper. The determination means determines the copying magnification and the timing of the paper feed means in response to a designation output of the mode designation means. The determined copying magnification is a ratio of the magnitude of the original image formed in an image area defined by subtraction of the binding margins from the size of the copy paper to a size of the original. The determined timing is timing for applying coincidence between a leading edge of the image area and that of the image on the photoconductor. The control means controls the image forming means and the paper feed means in response to the designation output of the mode designation means, based on the copying magnification and the timing determined by the determination means.

In order to accomplish the above described objects, a copying apparatus according to another aspect of the present invention comprises paper feed means, area determination means and image forming means. The paper feed means feeds paper for copy. The area determination means determines, as an image forming area, an area of the paper by subtraction of a width of a binding margin from a leading edge and from a rear edge of the paper fed by the paper feed means. The image forming means forms an original image on the image forming area of the paper fed by the paper feed means.

In order to accomplish the above described objects, a copying apparatus according to a further aspect of the present invention comprises first detection means, second detection means, copying magnification determining means and image forming means. The first detection means detects a size of an original to be copied. The second detection means detects a size of paper for copy. The copying magnification determining means determines, based on the size of the original detected by the first detection means and the size of the paper detected by the second detection means, a copying magnification enabling a magnitude of an image copied on the paper to be within the area of the paper and to be reduced at least in a longitudinal direction of the paper. The image forming means forms an image so that a center in the longitudinal direction of the paper having the size detected by the second detection means may coincide with a center of the image of the original based on the copying magnification.

The copying apparatus thus constructed ensures binding margins of a predetermined width on both sides of copy paper and enables an image of an original to be transferred with a suitable magnification onto the copy paper. Consequently, no deficiency occurs in the copy image even if the copy paper is folded in two and filed.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 15A and 15B are tables showing data to be set for binding margins of 10 mm and 15 mm in the embodiment of FIG. 13.

DESCRIPTION OF THE PREFERRED EMBODIMENTS

Figure 1:
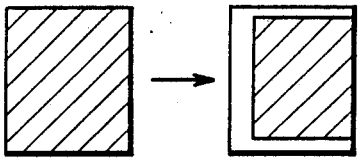
FIG.1 PRIOR ART
FIG. 1 illustrates an example in which an original is copied in a conventional one-sided binding margin mode.

A preferred embodiment of the present invention will be described referring to the drawings.

Figure 3:
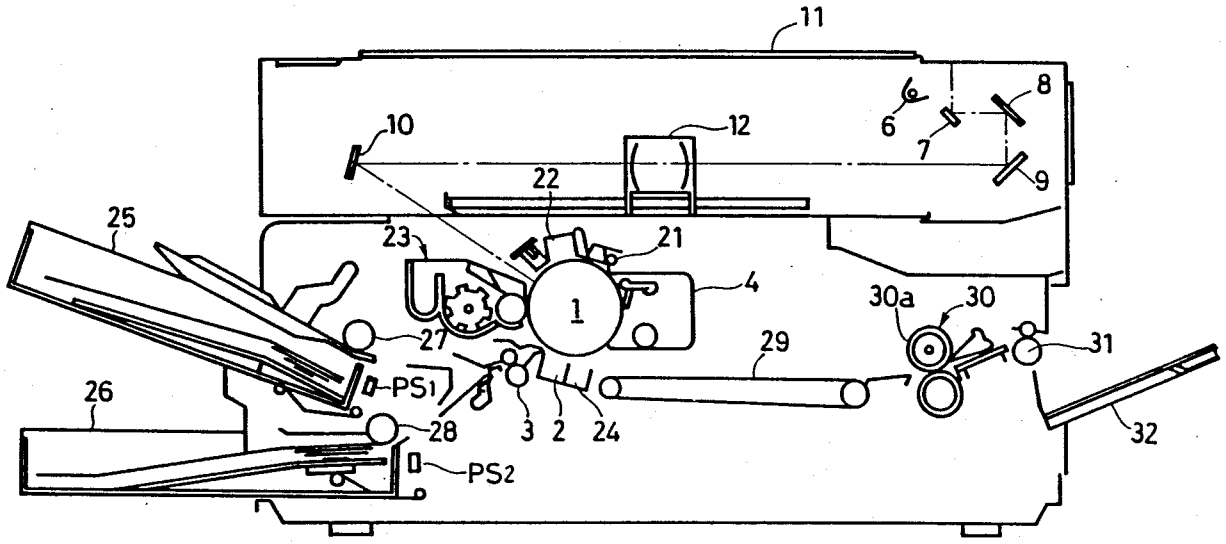
FIG. 3 is a schematic sectional view of a copying apparatus of an embodiment of the present invention.

FIG. 3 is a schematic sectional view showing a construction of a copying apparatus according to an embodiment of the present invention.

Figure 4:
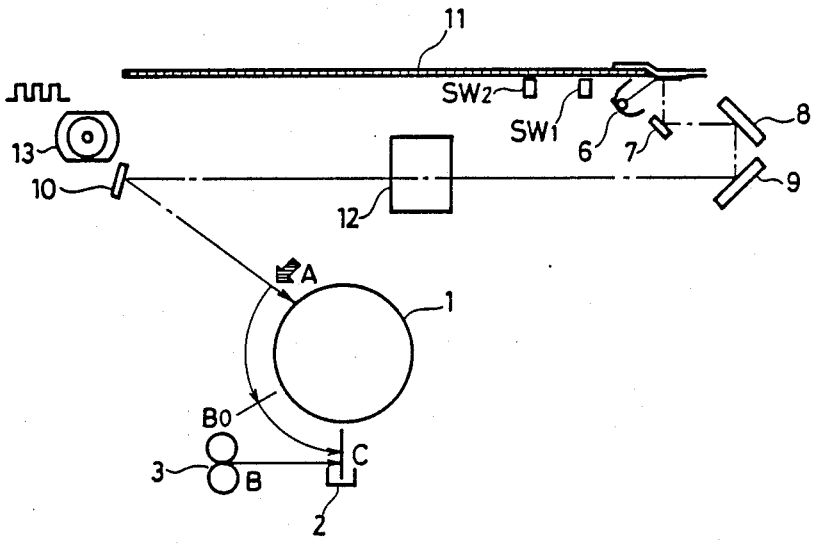
FIG. 4 is a schematic view showing a construction of a portion mainly including an optical system in the copying apparatus of FIG. 3.

FIG. 4 is a schematic view showing a construction of a portion mainly including an optical system of the copying apparatus of FIG. 3.

Referring to those figures, the construction and the operation of the copying apparatus will be described.

A transfer charger 2 and timing rollers 3 are provided around a photoconductor 1. An original on a document table 11 of glass is illuminated by an exposure lamp 6 and reflected light therefrom passes by means of a first mirror 7, a second mirror 8, a third mirror 9, a lens 12 and a fourth mirror 10, so that it is applied to the photoconductor 1. The lamp 6 and the first mirror 7 are driven at a speed V/n (where "V" is a rotating speed of the photoconductor and "n" is a copying magnification) and the mirrors 8 and 9 are driven at a speed V/2n by a scanner motor 13. The scanner motor 13 comprises a pulse generator (shown in FIG. 9) to be described later for generating pulses in proportion to the number of revolutions of the motor 13. In the following description, the lamp 6 and the first mirror 7 are collectively called a scanner. Positions of the lens 12 and the mirror 13 and a scanning speed are determined according to the set copying magnification. The scanning speed is controlled according to a speed of the scanner motor 13 dependent on the set magnification. Switches SW1 and SW2 provided under the document table 11 are turned on and off by the scanner and the timing rollers 3 are controlled by detection outputs of those switches. There are further provided, around the photoconductor 1, an eraser 21, a corona charger 22, a developing device 23, a separation charger 24, a cleaner 4 and the like in this order. On the other hand, paper feed cassettes 25 and 26 contain paper sheets of predetermined sizes. Paper fed from the cassette 25 or 26 is transported to a transfer portion 2 through the timing rollers 3 from a paper feed roller 27 or 28 in synchronization with image forming operation on the photoconductor 1 by movement of the optical system or the like. A toner image is formed on the photoconductor 1 subjected to development by the developing device 23 and the toner image is transferred onto the paper transported to the transfer portion 2 by means of the transfer charger 2 and the separation charger 24. The paper having the transferred image is separated from the photoconductor 1 and it is transported to a fixing device 30 through a transport portion 29. The toner image on the paper is thermally fixed by heating rollers 30*a* and then it is discharged by discharge rollers 31 and put on a discharge tray 32. In the figure, the reference characters PS1 and PS2 represent switches for detecting sizes of paper sheets contained in the cassettes 25 and 26, respectively.

Residual toner on the photoconductor 1 after it has passed the transfer portion is removed by the cleaner 4 and residual charge thereon is removed by the eraser 21, so that the copying apparatus is prepared for the next copy process.

In a normal mode where a binding margin is not formed, a leading edge of an image is caused to coincide with a leading edge of paper in the following manner.

Referring to FIG. 4, when the leading edge of the image formed at A on the photoconductor 1 by an exposure process comes to a position B0, the timing rollers 3 start to be driven. More specifically, the timing rollers 3 are driven so that a period of movement of the copy paper fed by the timing rollers 3 from a position B to a position C may be equal to a period of rotation of the leading edge of the image on the photoconductor 1 from the position B0 to the position C.

An on-signal for driving the timing rollers 3 is outputted with predetermined timing by a microcomputer to be described later. More specifically, the microcomputer has a counter for counting pulses generated by the scanner motor 13. This counter starts counting when the switch SW1 is turned on by the scanner. Then, when the count value of the counter attains a value corresponding to the copying magnification as a result of movement of the scanner, a CPU of the microcomputer provides the on-signal.

The switch SW2 serves to determine timing of output of the on-signal in copy operation with an equal-scale magnification. When a power supply of the copying apparatus is turned on, the scanner is operated temporarily and the count value of the counter at the time of turn-on of the switch SW2 is stored in the CPU as a count value for the equal-scale magnification. Count values for scaled-up copy and scaled-down copy are determined according to the respective magnifications based on the above described count value for the equal-scale magnification. When the count value of the counter attains the number based on the corresponding magnification during copy operation with that magnification, an on-signal for the timing rollers is outputted.

Figure 5:
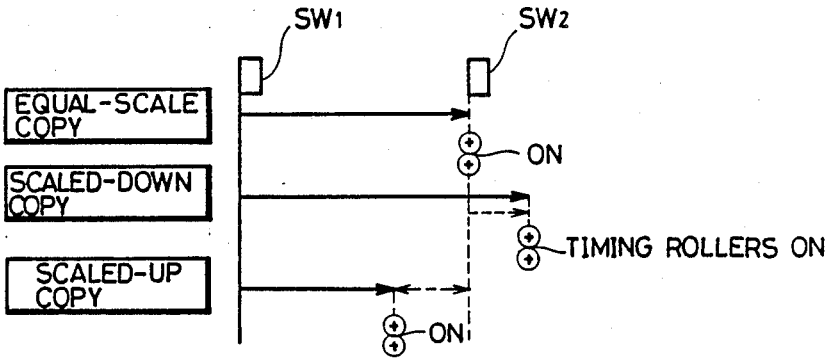
FIG. 5 is an illustration for explaining output timing of an on-signal of timing rollers in a normal mode in the embodiment of FIG. 3.

FIG. 5 is a diagram for explaining output timing of the on-signal of the timing rollers in the normal mode according to this embodiment.

As shown in the figure, the count value in scaled-down copy becomes large, while that in scaled-up copy becomes small compared with equal-scale copy.

Now, control of the timing rollers in a binding margin forming mode will be described.

Assuming that the time of turn-on of the timing rollers in the normal mode described above with reference to FIG. 5 is T0, that in the binding or blank margin forming mode comes earlier by a period corresponding to a width of a binding margin formed toward the leading edge of the paper.

Figures 6, 7:
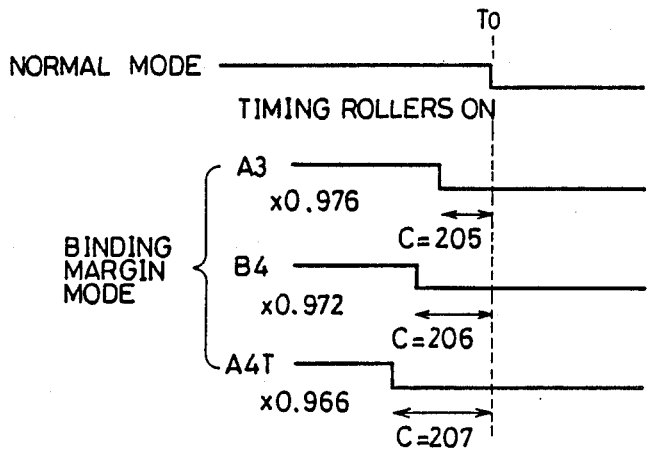
FIG. 6 is a diagram for explaining output timing of an on-signal of the timing rollers in a both-sided binding margin mode compared with the normal mode in the embodiment of FIG. 3.
FIG. 7 is a table showing data set in the both-sided binding margin mode in the embodiment of FIG. 3.

FIG. 6 is a diagram for explaining output timing of the on-signal of the timing rollers in a both-sided binding margin mode compared with the normal mode in the above described embodiment of the invention.

Figure 2:
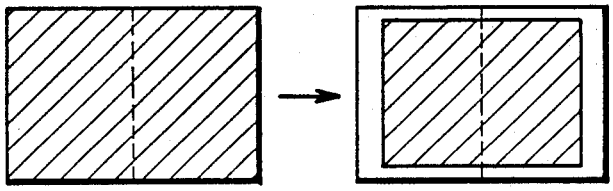
FIG. 2 illustrates an example in which an original is copied in a both-sided binding margin mode for filing the copy folded in two.

Assuming that a width of each binding margin is uniformly set to 5 mm for example, the time of turn-on of the timing rollers in the binding margin forming mode is changed from T0 to a value obtained by subtraction of a count value (C) corresponding to the paper size from the time T0. Thus, the center line of the image of the original scaled-down as shown in FIG. 2 coincides with the center line of the copy paper and binding margins of the same width are formed at the leading edge and at the rear edge of the paper.

FIG. 7 is a table showing set data in the both-sided binding margin mode in the embodiment of the invention.

This table shows adjustment magnifications Z for the respective paper sizes taking account of 5 mm as a width of a binding margin and count values C defined by subtraction from the count values in the normal mode for determining timing of turn-on of the timing rollers (for coincidence between a leading edge of an image and a leading edge of paper).

Each adjustment magnification Z is obtained in the following manner.

$$Z=(\text{paper length}-\text{binding margin width}\times 2)/\text{paper length}$$

For example, if binding margins of 5 mm are to be formed on both sides of paper of the A3 size, the magnification Z is as follows.

$$Z=(420-5\times 2)/420=0.976$$

If copy operation is to be carried out in the both-sided binding margin mode, a magnification m to be applied to the copy operation is obtained by multiplication of a desired copying magnification M by the adjustment magnification Z in the following equation.

$$m=M\times Z$$

The data in the above described table are stored in a ROM 20 to be accessed by the CPU in FIG. 9 mentioned below.

Figure 8:
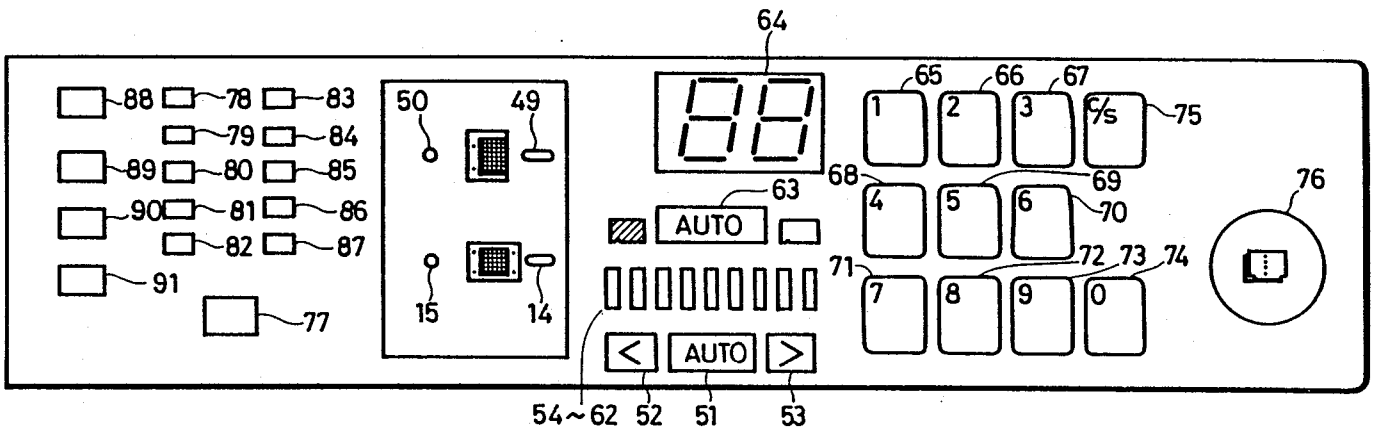
FIG. 8 is an illustration showing a layout on an operation panel of the copying apparatus in the embodiment of FIG. 3.

FIG. 8 is an illustration showing a layout of an operation panel of the copying apparatus in the above described embodiment.

Referring to FIG. 8, the operation panel comprises: a key 14 for setting the both-sided binding margin mode; a both-sided binding mode display LED 15 to be turned on when the both-sided binding mode margin is set; a key 49 for setting the one-sided (normal) binding margin mode; a one-sided binding margin mode display LED 50 to be turned on when the one-sided binding margin mode is set; a key 51 for automatically setting an exposure mode; keys 52 and 53 for manually adjusting an exposure value; display elements 54 to 62 for displaying the set exposure value; a display portion 63 for displaying an automatic exposure mode; a display portion 64 for displaying the number of copies; ten keys 65 to 74 for setting the number of copies; a clear stop key 75; a print key 76; a selection key 77 for selecting a suitable paper feed cassette; paper size display elements 78 to 87 for displaying a size of paper contained in the selected cassette; and magnification selection keys 88 to 91 for selecting a copying magnification.

Figure 9:
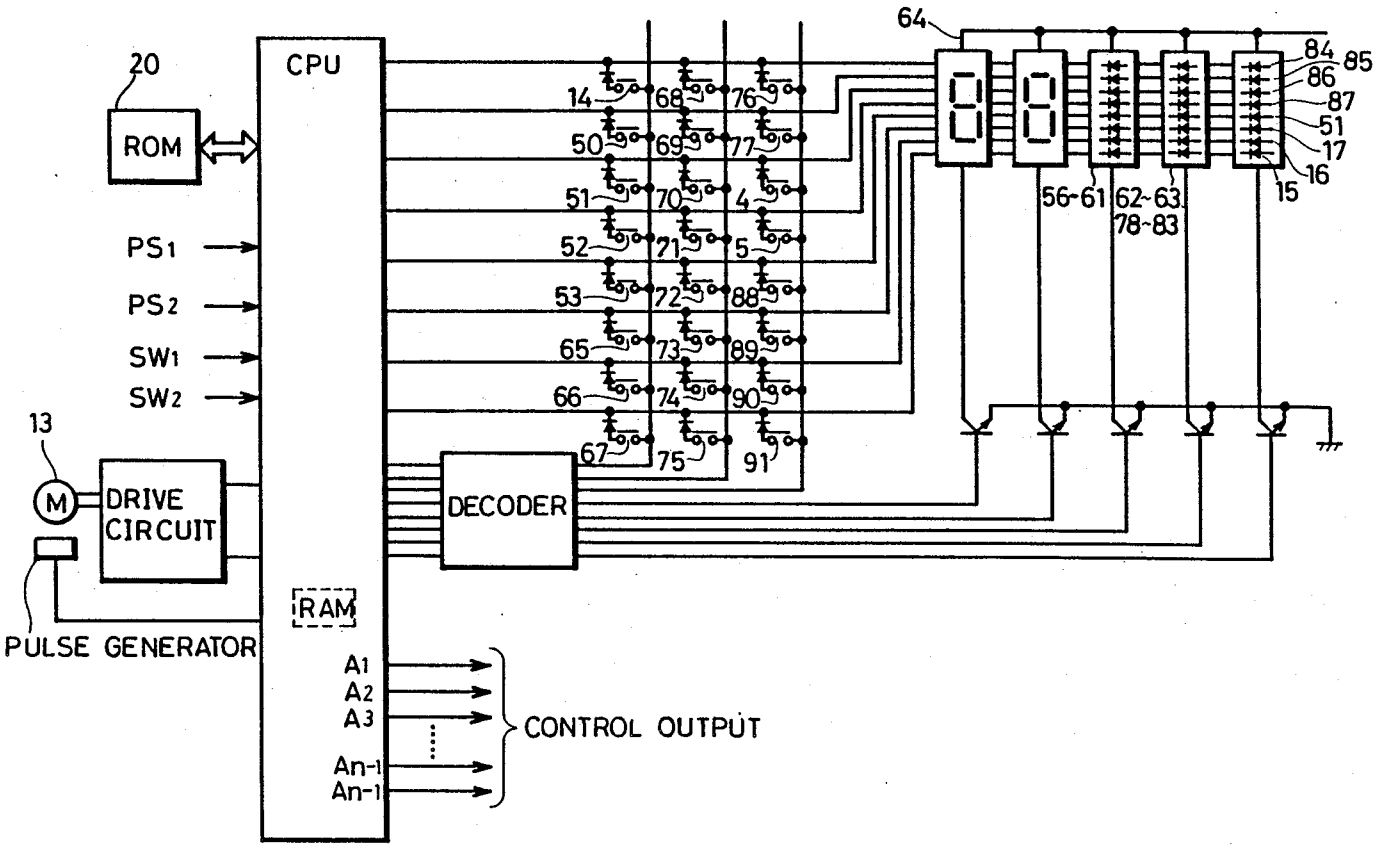
FIG. 9 is a diagram showing a configuration of a control circuit contained in the copying apparatus in the embodiment of FIG. 3.

FIG. 9 is a diagram showing a configuration of a control circuit contained in the copying apparatus according to the above described embodiment.

Referring to FIG. 9, signals are inputted from the keys of the operation panel and the switches PS1, PS2, SW1, SW2 etc. or the sensors in the copying apparatus to the CPU (Central Processing Unit). The CPU has a RAM therein for controlling various displays and copy operation based on those input signals and temporarily storing various data. In other words, keY operation and display of the operation panel shown in FIG. 8, detection of a paper size for setting a binding margin, change of the copying magnification, operation of the timing rollers and the like are all controlled by the CPU. In the following, copy operation in the both-sided binding margin mode with the width of each binding margin of 5 mm will be described with reference to the flow charts in FIGS. 10 to 12.

Figure 10:
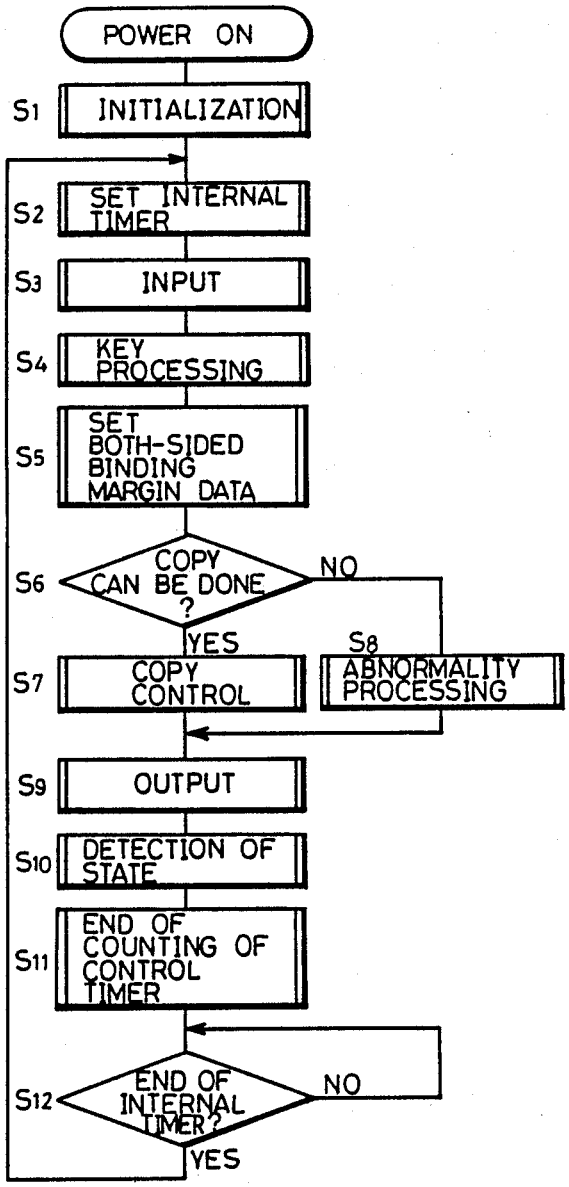
FIG. 10 is a flow chart of a main routine showing entire control procedures of the copying apparatus by a CPU shown in FIG. 9.

FIG. 10 is a flow chart of a main routine showing the whole control procedures of the CPU shown in FIG. 9.

When the power supply is turned on, the content of the RAM in the CPU is cleared and initialization for the normal copy mode is effected in the step S1. Then, an internal timer in the CPU is set in the step S2. This timer defines a period required for the below described control, that is, a period required for one routine. In the step S3, signals from the operation panel shown in FIG. 8 as well as signals from the switches and the sensors in the copying apparatus are inputted and processing for the operated keys is performed in the subsequent step S4.

In the step S5, processing for setting both-sided binding or blank margin data, which constitutes the main feature the present invention, is performed. More specifically, a copying magnification and paper feed timing are determined based on the binding margin width and the paper size. In the subsequent steps S6 to S8, it is determined whether copy operation is permitted or not. If it is permitted, copy operation (including a waiting state) is controlled based on the copying magnification and paper feed timing determined in the step S7 and a copy with binding margins being formed on both sides of the paper is obtained. If copy operation is not permitted, processing in the case of abnormality is performed in the step S8.

In the subsequent step S9, a control signal, a display signal and the like are outputted. In the step S10, detection is made as to states of the copying apparatus such as abnormality, emptiness of toner, or emptiness of paper. Finally, in the step S11, counting of a timer for control comes to an end and in the step S12, an end of counting of the internal timer is determined. If the internal timer comes to an end, the processing flow returns to the step S2 and the above described processing is performed again.

Figure 11:
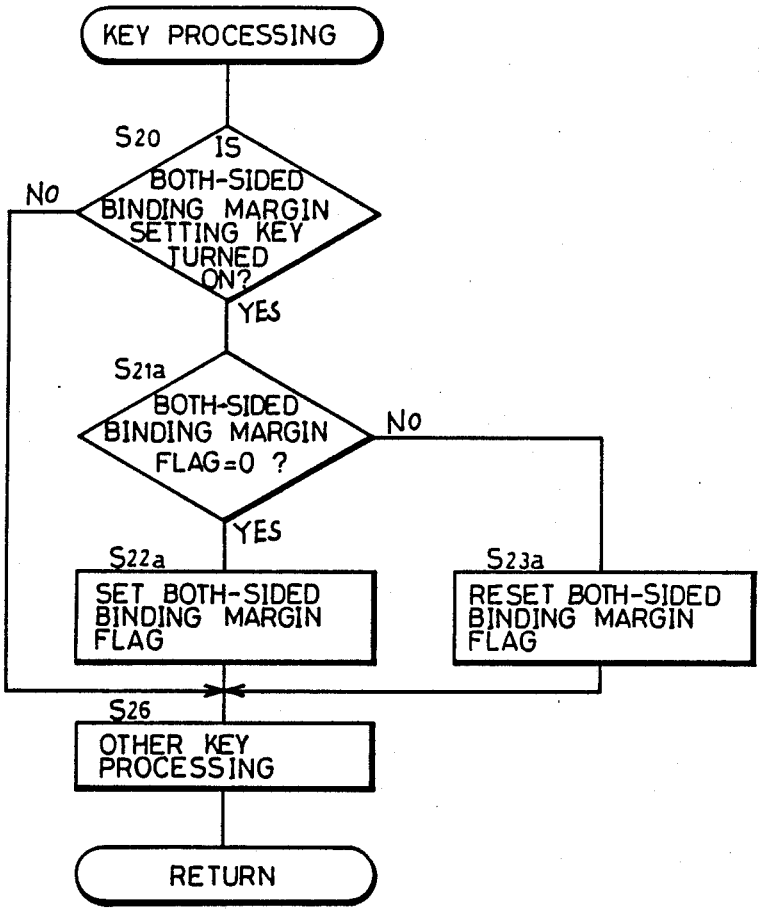
FIG. 11 is a flow chart showing concrete procedures of key processing in step S4 of FIG. 10.

FIG. 11 is a flow chart showing concrete procedures of the key processing in the step S4 in FIG. 10.

In the following, the procedures will be described referring to FIG. 11.

In the step S20, it is determined whether the key 14 for setting the both-sided binding margin mode is turned on or not. If turn-on of the key 14 is determine, the content of a both-sided binding margin flag in the RAM of the CPU is determined in the step S21*a*. The content "1" of the both-sided binding margin flag represents the both-sided binding margin mode and "0" thereof represents other modes. If the both-sided binding margin flag is "0", the both-sided binding margin flag is set in the step S22*a*. If the both-sided binding margin flag is "1", that is, if the both-sided binding margin mode is set, the both-sided binding margin flag is reset (in the step S23*a*). When the above described processing is terminated, or if the key 14 for setting the both-sided binding margin mode is not turned on in the step S20, other key processing is performed in the step S26.

Figure 12:
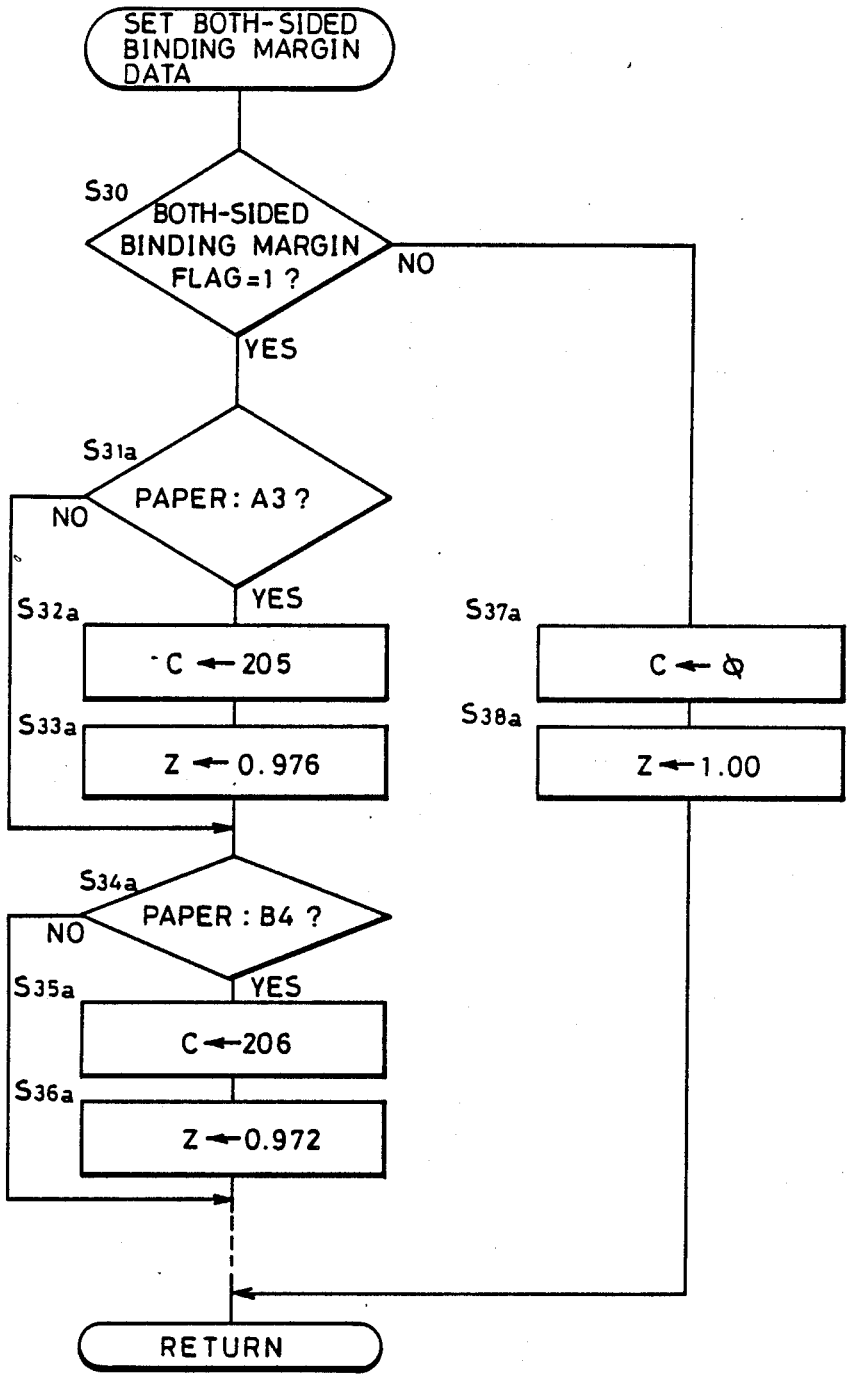
FIG. 12 is a flow chart showing concrete procedures for setting both-sided binding margin data in step S5 of FIG. 10.

FIG. 12 is a flow chart for explaining concrete procedures for setting both-sided binding margin data in the step S5 in FIG. 10.

Referring to FIG. 12, the procedures will be described.

It is determined in the step S30 whether the both-sided binding margin flag is "0" or not, that is, whether the both-sided binding margin mode is set or not. If the flag is "0", which means that the both-sided binding margin is not set, the count value for bringing forward the time of turn-on of the timing rollers is cleared in the steps S37*a* and S38*a* and the variable magnification ratio Z is also cleared. If the flag is "1", it is determined that the both-sided binding margin mode is set and in the step S31*a*, a paper size is determined. Data corresponding to the paper size is read out from the table memory shown in FIG. 7 and the count value C and the variable magnification ratio Z are set. Although the both-sided binding margin mode is applied to paper of the A3 or B4 size in the paper feed cassette according to this embodiment, this mode is also applicable to paper of other sizes.

Although the binding margin width is fixed to 5 mm in the above described embodiment, the binding margin width may be variable.

FIGS. 13 to 16 show another embodiment of the present invention, in which the binding margin width can be selected among 5 mm, 10 mm and 15 mm.

Referring to the figures, this second embodiment will be described.

Figure 13:
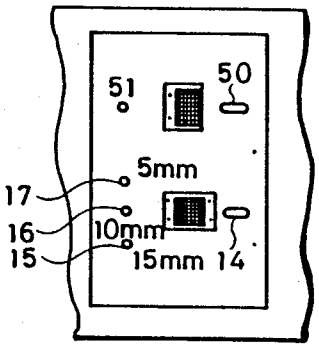
FIG. 13 is an illustration showing a portion of an operation panel in another embodiment of the present invention.

FIG. 13 is a plan view showing a portion of an operation panel.

In FIG. 13, portions not shown are substantially the same as in the operation panel of the above described first embodiment (shown in FIG. 8). The operation panel of FIG. 13 comprises three LEDs 15 to 17 to be turned on in response to operation of the both-sided binding mode setting key 14. When the key 14 is pressed while the LEDs 15 to 17 are all turned off, the LED 17 indicating the binding margin width of 5 mm is turned on. When the key 14 is pressed while the LED 17 is turned on, the LED 16 indicating the binding margin width of 10 mm is turned on. When the key 14 is pressed while the LED 16 is turned on, the LED 15 indicating the binding margin width of 15 mm is turned on. When the key 14 is pressed while the LED 15 is turned on, all the LEDs 15 to 17 are turned off.

Figure 14:
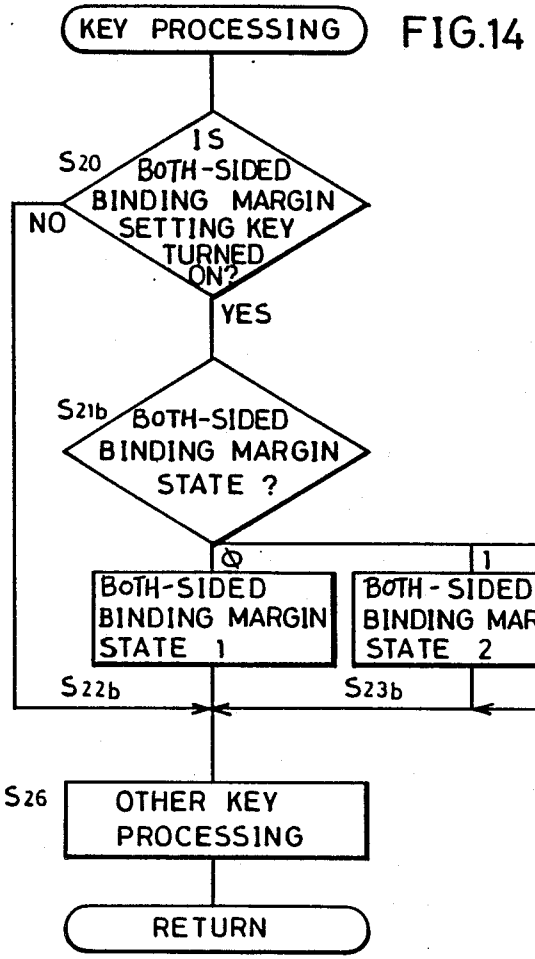
FIG. 14 is a flow chart showing concrete procedures of key processing in the embodiment of FIG. 13.

FIG. 14 is a flow chart showing concrete procedures of the key processing corresponding to FIG. 11 in the case of the first embodiment.

This flow chart indicates procedures for selecting a binding margin width corresponding to FIG. 13. In the following, the procedures will be described.

When turn-on of the both-sided binding margin mode setting key 14 is detected, a both-sided binding margin state is determined in the step S21*b*. When the both-sided binding margin state is any of "1" to "3", the both-sided binding margin mode is set and when the state is "0", other mode is set. If it is determined in the steps S22*b* to S25*b* that the state is "3", the state is reset to "0" and if the state is not "3", "1" is added to the state. If the above described processing is terminated, or if the condition in the step S20 is not satisfied, other key processing is performed in the step S26.

FIGS. 15A and 15B are tables showing set data for the binding margin widths 10 mm and 15 mm corresponding to FIG. 7 in the previously described first embodiment.

In this second embodiment, the tables concerning the binding margin widths 10 mm and 15 mm as well as the table for the binding margin width 5 mm as shown in FIG. 7 are stored in the ROM of the CPU and the data are fetched as required.

Figure 16:
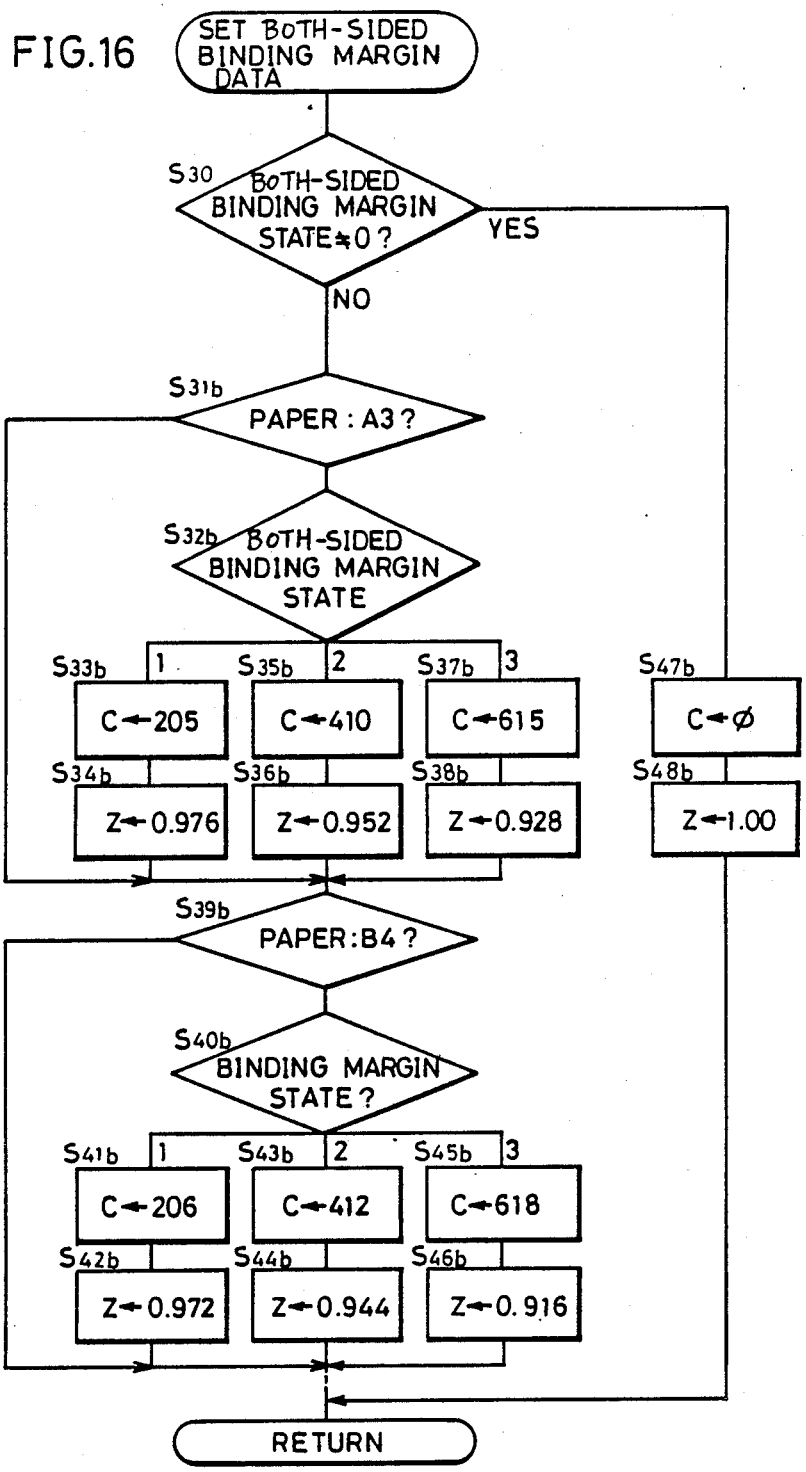
FIG. 16 is a flow chart showing concrete procedures for setting both-sided binding margin data in the embodiment of FIG. 13.

FIG. 16 is a flow chart showing concrete procedures for setting both-sided binding margin data, corresponding to FIG. 12 in the previously described embodiment.

Referring to FIG. 16, the procedures will be described.

First, it is determined in the step S30 whether the both-sided binding margin state is "0" or not, that is, whether the both-sided binding margin mode is set or not. If the state is "0", which means that the both-sided binding margin is not set, the count value C for bringing forward the time of turn-on of the timing rollers shown in FIGS. 7, 15A and 15B is cleared in the step S47*b* and the variable magnification ratio Z is also cleared in the step S48*b*.

If it is determined in the step S30 that the both-sided binding margin mode is set, data corresponding to the paper size and the both-sided binding margin state are read out from the corresponding table and the count value C and the variable magnification ratio Z are set in the steps beginning with S31*b*. More specifically, if the state is "1", the data are read out from the memory table shown in FIG. 7; if the state is "2", the data are read out from the memory table shown in FIG. 15A; and if the state is "3", the data are read out from the memory table shown in FIG. 15B.

Although the flow chart of FIG. 16 typically shows the cases of the paper sizes A3 and B4, the count value C and the variable magnification ratio Z can be also set for other paper sizes based on the set data of those memory tables.

Thus, in this second embodiment, copy operation is carried out in the both-sided binding margin mode by setting the binding margin width to a predetermined value. Although the count value and the variable magnification ratio Z are read out from the memory tables prepared in advance in the above described both embodiments, those values may be set by evaluation as required.

In the above described two embodiments, the both-sided binding margin mode is applicable not only to a sheet of an original but also to two sheets of originals. More specifically, two sheets of originals of the A4 size each placed transversely, that is, with its longer sides being perpendicular to the scanned direction can be copied on paper of the A3 size placed longitudinally, that is, with its longer sides being parallel to the paper feed direction, or two sheets of originals of the B5 size each placed transversely can be copied on paper of the B4 size placed longitudinally. Similarly, two sheets of originals of the B5 size each placed transversely can be copied on paper of the A3 size placed longitudinally. In this case, if each binding margin width is 5 mm, copy is carried out with the magnification 410/364=1.126 which scales up a dimension of 364 mm, i.e., twice 182 mm of the B5 size to a dimension of 410 mm defined by subtraction of 10 mm, i.e., twice 5 mm of each binding margin width from 420 mm of the A3 size.

As described in the foregoing, according to the present invention, a binding margin can be provided on each of the two opposing sides of copy paper and this is convenient for filing the paper by folding it in two. In addition, any of predetermined binding margin widths can be set by choice of the user and the apparatus becomes more convenient to use.

Furthermore, such binding margins on the two sides of the copy paper can be provided only by adjustment of timing for transfer of the original image onto the paper and setting of the variable magnification ratio. Thus, since the construction of a conventional copying apparatus can be adopted as it is, the present invention has an advantage in cost effectiveness.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus having a blank margin forming function, comprising:

a rotatable photoconductor, image forming means for forming an image of an original on said photoconductor with an arbitrary magnitude based on a copying magnification, paper feed means for feeding paper for copy to a predetermined transfer position with specified timing, transfer means for transferring the image on said photoconductor, formed by said image forming means onto the copy paper at said transfer position, fed by said paper feed means, detection means for detecting a size of the copy paper fed by said paper feed means, mode designation means for designating a blank margin forming mode for ensuring a first blank margin of a predetermined width on a leading edge of the copy paper and a second blank margin of said predetermined width on a rear edge of the copy paper, determination means for determining said copying magnification and said specified timing in response to a designation output from said mode designation means, the determined copying magnification being a ratio of the magnitude of the image of the original formed in an image area defined by subtraction of said first and second blank margins from the size of the copy paper to a size of the original, and the determined specified timing being timing for enabling a leading edge of said image area to coincide with a leading edge of the image on said photoconductor, and control means responsive to the output from said mode designation means, for controlling said image forming means and said paper feed means based on the copying magnification and the specified timing determined by said determination means, whereby the image of the original is copied on the copy paper with forming the first blank margin on the leading edge of the copy paper and the second blank margin on the rear edge of the copy paper, the width of said first and second blank margins being equal to each other.

2. A copying apparatus having a blank margin forming function, comprising:

paper feeding means for feeding copy paper, means for entering data defining a desired width of the blank margin, area determination means for determining, as an image forming area, an area of the paper defined by subtraction of said desired width from each of a leading edge and a rear edge of the paper fed by said paper feed means, and image forming means for forming an image of original on said image forming area of the paper fed by said paper feed means, whereby a first blank margin of the desired width is formed on the leading end of the copy paper and a second blank margin of the desired width as the first blank margin is formed on the rear end of the copy paper.

3. A copying apparatus in accordance with claim 2, wherein said image forming means comprises copying magnification determining means for determining a copying magnification based on a size of said image forming area and a size of the original, and forms the image of the original based on the copying magnification determined by said copying magnification determining means.

4. A copying apparatus in accordance with claim 3, wherein said image forming means comprises a photoconductor for forming the image of the original thereon, and said photoconductor rotates to transfer the image on said photoconductor onto the paper at a predetermined transfer position, fed by said paper feed means.

5. A copying apparatus in accordance with claim 4, wherein said image forming means comprises control means for controlling said paper feed means to enable a leading edge of said image forming area to be coincident with said transfer position.

6. In a copying apparatus which forms an image of the original on a rotatable photoconductor at various magnifications and feeds copy paper to a transfer position at variable timing with a speed corresponding to that of the photoconductor, and which transfers the image on the photoconductor onto the paper at the transfer position, a method of forming the image on the copy paper with first and second blank margins on both a leading edge and a rear edge of the copy paper, respectively, comprising the steps of:

detecting the length of the paper to be fed;

entering a primary copy magnification (M) by which the image size of the original corresponds to the copy paper;

entering data which defines a width of a first blank margin to be formed on the leading edge of the copy paper, determining an adjusting magnification (Z) based on the paper length (PL) and the blank margin width (BM), said adjusting magnification, paper length and blank margin width determined by:

$$Z = \frac{PL - BM \times 2}{PL}$$

forming the image of the original on the photoconductor at a special magnification (m) determined by:

$$m = (M \times Z)$$

feeding the copy paper to the transfer position so that the blank margin on the leading end of the copy paper passes through the transfer position before the leading end of the image on the photoconductor arrives at the transfer position; and transferring the image on the photoconductor onto the copy paper at the transfer position, whereby the image of the original is formed on the copy paper with the first binding margin and the second binding margin both having the same width on the leading edge and the rear edge of the copy paper, respectively.

7. A copying apparatus having a blank margin forming function, comprising:

a rotatable photoconductor, image forming means for forming an image of an original on said photoconductor with an arbitrary magnitude based on a copying magnification, paper feed means for feeding paper for copy to a predetermined transfer position with specified timing, transfer means for transferring the image on said photoconductor, formed by said image forming means onto the copy paper at said transfer position, fed by said paper feed means, detection means for detecting a size of the copy paper fed by said paper feed means, mode designation means for designation of blank margin forming mode for ensuring a first blank margin of a predetermined width on a leading edge of the copy paper and a second blank margin of said predetermined width on a rear edge of the copy paper, said mode designating means comprising blank margin designation means for designating the width of the blank margin, determination means for determining said copying magnification and said specified timing in response to a designation output from said mode designation means, the determined copying magnification being a ratio of the magnitude of the image of the original formed in an image area defined by subtraction of said first and second blank margins from the size of the copy paper to a size of the original, and the determined specified timing being timing for enabling a leading edge of said image area to coincide with a leading edge of the image on said photoconductor, and control means responsible to the output from said mode designating means, for controlling said image forming means and said paper feed means based on the copying magnification and the specified timing determined by said determination means, whereby the image of the original is copied on the copy paper with forming the first blank margin on the leading edge of the copy paper and the second blank margin on the rear edge of the copy paper, the width of said first and second blank margins being equal to each other.

8. A copying apparatus in accordance with claim 7, wherein said determination means comprises data storing means for storing data for determining the copying magnification and the timing for feeding said copy paper based on the size of the copy paper and the width of the binding margin.

* * * * *